US008197181B2

(12) United States Patent
Park et al.

(10) Patent No.: US 8,197,181 B2
(45) Date of Patent: Jun. 12, 2012

(54) CROSS-FLOW FAN AND AIR CONDITIONER

(75) Inventors: Jeong Taek Park, Seoul (KR); Ki Won Seo, Seoul (KR); Deok Huh, Seoul (KR)

(73) Assignee: LG Electronics Inc., Seoul (KR)

( * ) Notice: Subject to any disclaimer, the term of this patent is extended or adjusted under 35 U.S.C. 154(b) by 974 days.

(21) Appl. No.: 12/222,594

(22) Filed: Aug. 12, 2008

(65) Prior Publication Data

US 2009/0104017 A1 Apr. 23, 2009

(30) Foreign Application Priority Data

Oct. 23, 2007 (KR) ..... 10-2007-0106424

(51) Int. Cl.
*F04D 5/00* (2006.01)

(52) U.S. Cl. ..... 415/53.1; 415/53.2; 415/53.3

(58) Field of Classification Search ..... 415/53.1, 415/53.2, 53.3
See application file for complete search history.

(56) References Cited

U.S. PATENT DOCUMENTS

| | | | | |
|---|---|---|---|---|
| 2,942,773 | A * | 6/1960 | Eck | 415/53.2 |
| 3,970,411 | A * | 7/1976 | Wallman | 416/178 |
| 2007/0177971 | A1 | 8/2007 | Teraoka et al. | |
| 2009/0104032 | A1 * | 4/2009 | Park et al. | 415/208.1 |

FOREIGN PATENT DOCUMENTS

| | | | |
|---|---|---|---|
| CN | 1147600 | | 4/1997 |
| JP | 04-019395 | A | 1/1992 |
| JP | 09-100795 | | 4/1997 |
| JP | 09-250493 | A | 9/1997 |
| JP | 10-077988 | | 3/1998 |
| JP | 10-205798 | A | 8/1998 |
| JP | 2003-090300 | A | 3/2003 |
| JP | 2004-100663 | | 4/2004 |
| JP | 2006-170043 | | 6/2006 |
| KR | 20-1991-0005979 | U | 4/1991 |

* cited by examiner

*Primary Examiner* — Jarrett Stark
*Assistant Examiner* — Nicholas Tobergte
(74) *Attorney, Agent, or Firm* — McKenna Long & Aldridge LLP

(57) ABSTRACT

A cross-flow fan that variably maintains a distance between a blade and a fluid flow guide by varying a height of an outer edge and an air conditioner having the cross-flow fan are provided. Therefore, a noise and a peak value of a spectrum between the blade and the outer edge can be reduced.

8 Claims, 17 Drawing Sheets

CROSS-FLOW FAN AND AIR CONDITIONER

CROSS-REFERENCE TO RELATED APPLICATIONS

This application claims the benefit of Korean Patent Application No. 10-2007-0106424, filed on Oct. 23, 2007, which is incorporated by reference in its entirety.

BACKGROUND

The present disclosure relates to a cross-flow fan and an air conditioner having the cross-flow fan.

Generally, an air conditioner is a system that is used to control the temperature of air in an enclosed space such as a room, building, and the like.

The air conditioner includes a heat exchanger in which refrigerant flows. A cross-flow fan is disposed at a side of the heat exchanger to supply air. The cross-flow fan introduces the air in a radial direction and discharges the air in the radial direction.

A fluid flow guide is disposed near an outer circumference of the cross-flow fan. The fluid flow guide guides the flow of the air introduced and discharged by the cross-flow fan.

SUMMARY

Embodiments provide a cross-flow fan that is designed to reduce a noise generated between the blade and the fluid flow guide and an air conditioner having the cross-flow fan. In one embodiment, a cross-flow fan includes a plurality of blades arranged at least in a partial circumference, where a longitudinal axis of one blade is substantially parallel to another longitudinal axis of another blade, and a height of one portion of a blade is different from a height of another portion of the blade.

In another embodiment, an air conditioner includes a heat exchanger installed in a case, a cross-flow fan disposed at a side of the heat exchanger and having a plurality of blades, and a fluid flow guide disposed near an outer circumference of the cross-flow fan, where a distance between an edge of the fluid flow guide and one edge portion of a blade is different from a distance between the edge fluid flow guide and another edge portion of the blade.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. Although embodiments will be described with reference to a number of illustrations thereof, it should be understood that numerous other modifications and embodiments can be devised by those skilled in the art that will fall within the spirit and scope of the principles of the present invention.

Figure 1:
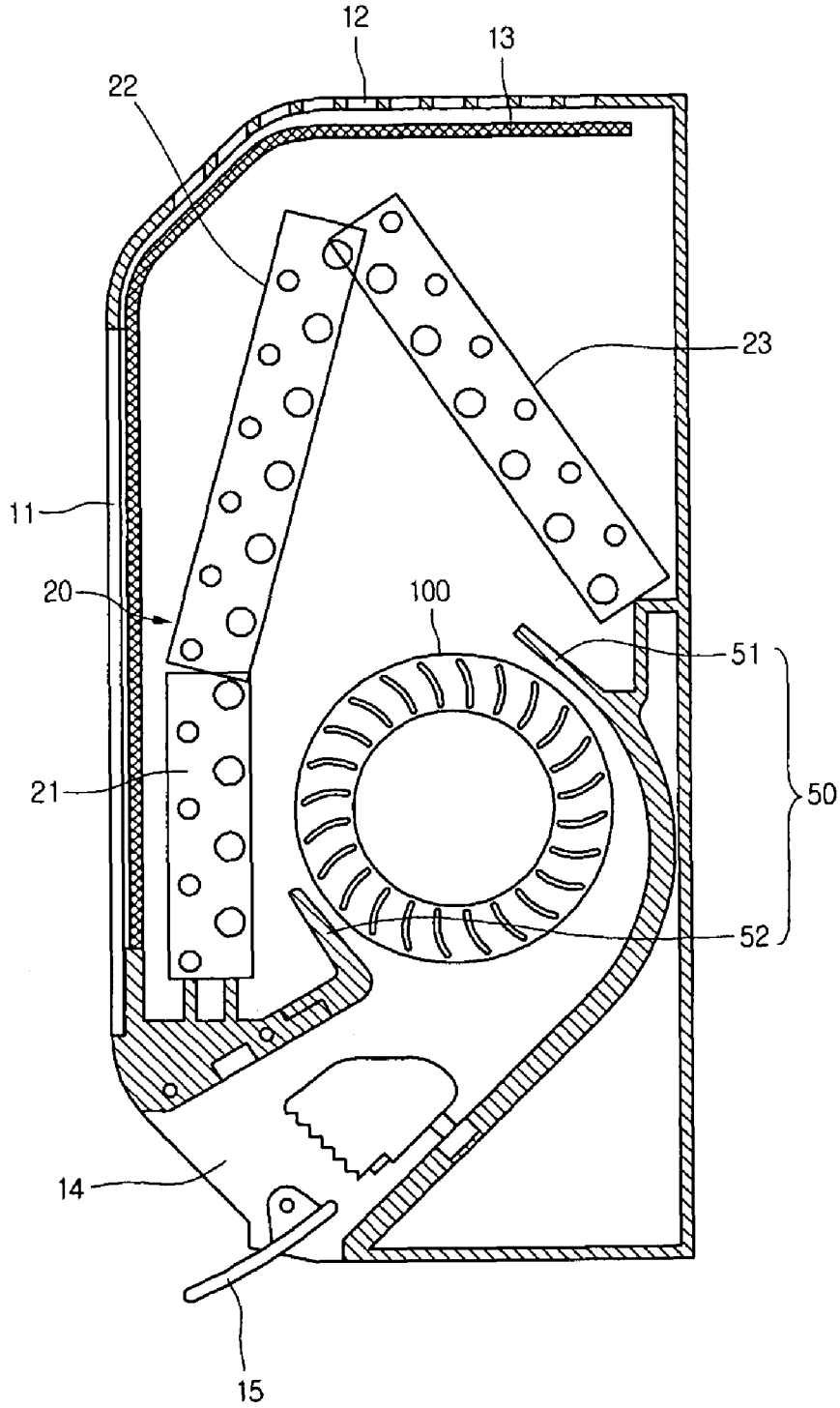
FIG. 1 is a sectional view of an air conditioner according to an embodiment.

FIG. 1 is a sectional view of an air conditioner according to an embodiment.

Referring to FIG. 1, an air conditioner of this embodiment includes a case 10, a heat exchanger 20 disposed in the case 10, and a cross-flow fan 100 disposed in the case 10.

A front air intake portion 11 is formed at a front portion of the case 10 and a top air intake portion 12 is formed at a top portion of the case 10. A filter 13 for filtering off foreign objects contained in the air introduced through the front and top air intake portions 11 and 12 may be provided. The filter 13 may be detachably fixed at the front portion of the case 10.

An air outlet portion 14 is formed at a lower portion of the case 10. An air outlet louver 15 may be disposed at the air outlet portion 14 to adjust an air discharge direction and an air discharge angle. The air outlet louver 15 may be controlled to close when the air conditioner stops operating.

The heat exchanger 20 is disposed such that the air introduced through the front and top air intake portions 11 and 12 can pass therethrough. The heat exchanger 20 may include a refrigerant tube along which refrigerant flows and a plurality of heat exchange fins through which the refrigerant tube penetrates.

The heat exchanger 20 is disposed to surround an air intake side of the fan 100. For example, the heat exchanger 20 may include a plurality of heat exchange units 21, 22, and 23 that are disposed at different angles to surround the air intake side of the fan 100. Since the heat exchange units 21, 22, and 23 are disposed at different angles in the case 10, a size of the heat exchanger 20 may be increased in a limited space, thereby increasing the heat exchange capacity. Needless to say, the heat exchanger 20 may be formed as a single body and the heat exchange units 21, 22, and 23 may be defined by bending the single body.

The fan 100 is disposed at a side of the heat exchanger 20. A cross-flow fan that intakes the air in a radial direction and discharges the introduced air in the radial direction may be used as the fan 100. The cross-flow fan 100 will be described in more detail later.

A fluid flow guide 50 is disposed near an outer circumference of the cross-flow fan 100. The fluid passage effectively guides the air intake/air exhaust produced by the cross-flow fan 100. The fluid flow guide 50 may include a rear guide 51 and a stabilizer 52.

The rear guide 51 may extend from a rear side of the case 10 to the air intake side of the cross-flow fan 100. The rear guide 51 is designed to effectively guide the introduced air toward the cross-flow fan 100 by the rotation of the cross-flow fan 100. Further, the cross-flow fan 100 may minimize the delaminating of the flowing air.

The stabilizer 52 may be disposed near an exhaust side of the cross-flow fan 100. The stabilizer 52 may be installed to be spaced apart from the outer circumference of the cross-flow fan 100, thereby preventing the air exhausted from the cross-flow fan 100 from adversely flowing toward the heat exchanger 20.

The rear guide 51 and the stabilizer 52 may be disposed in a lengthwise direction of the cross-flow fan 100. The rear guide 51 and the stabilizer 52 may be installed to be spaced apart from the outer circumference of the cross-flow fan 100 by predetermined distances.

When the cross-flow fan 100 rotates, the air is sucked in through the front and top air inlet portions 11 and 12. The introduced air heat-exchanges while passing through the heat exchanger 20, and being directed to the cross-flow fan 100. At this point, the air is effectively sucked to the rear guide 51. The cross-flow fan 100 directs the air from the rear guide 51 to the air exhaust portion. At this point, the air exhausted from the cross-flow fan 100 is not directed toward the heat exchanger 20 by the stabilizer 52 and thus, the air is discharged to an enclosed space such as a room through the air outlet 14.

Figure 2:
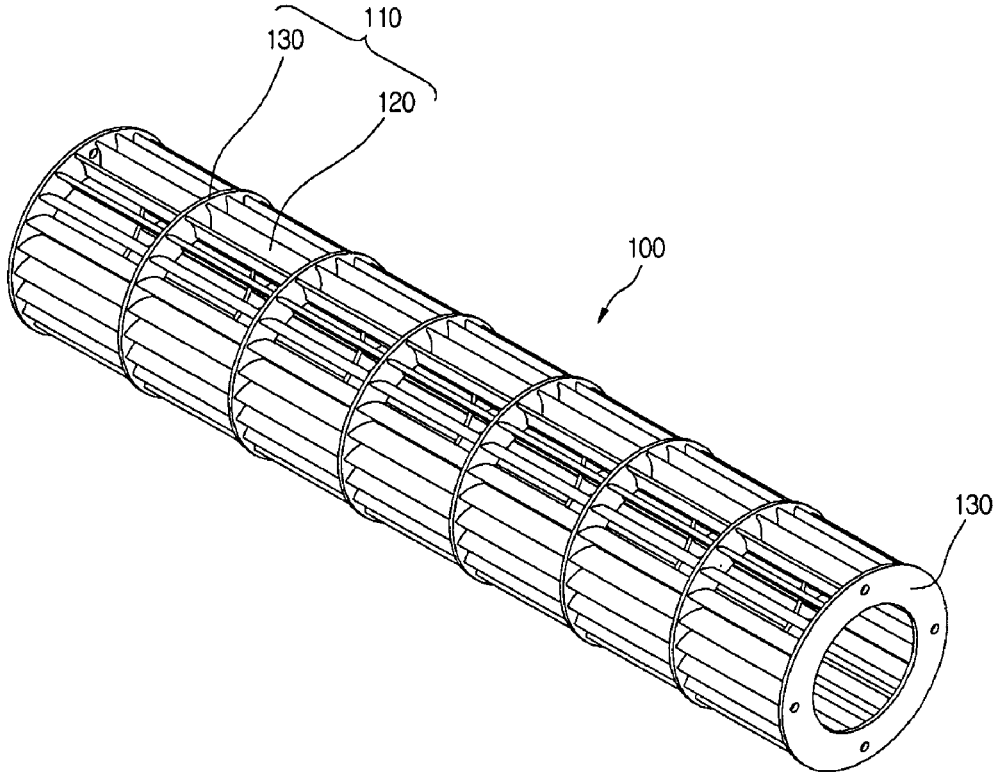
FIG. 2 is a perspective view of a cross-flow fan according to an embodiment.
Figure 3:
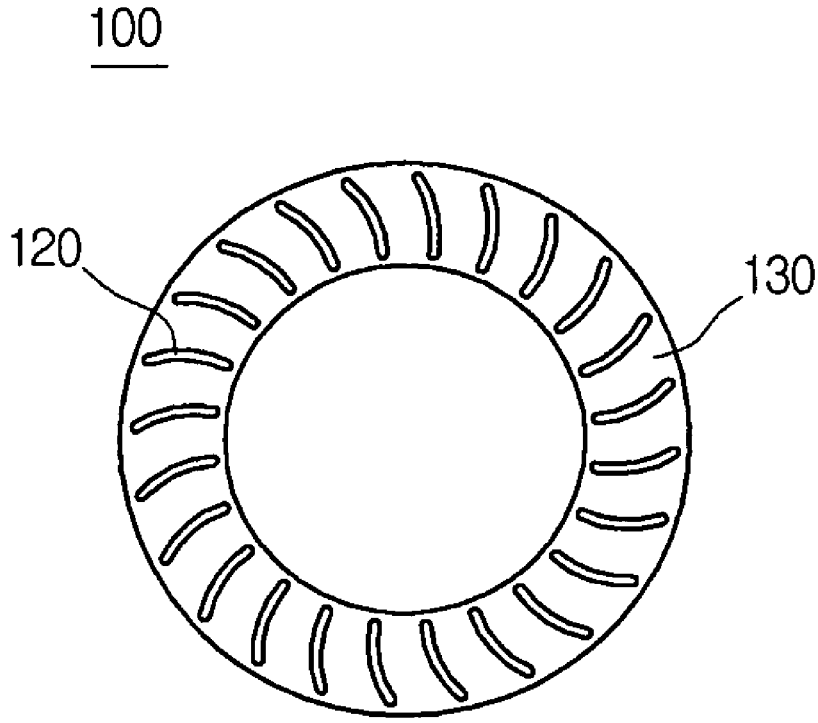
FIG. 3 is a side view of the cross-flow fan of FIG. 2.

FIG. 2 is a perspective view of a cross-flow fan according to an embodiment and FIG. 3 is a side view of the cross-flow fan of FIG. 2.

Referring to FIGS. 2 and 3, the cross-flow fan 100 may include a plurality of fan units 110 that are coupled to one another in the lengthwise direction. Each of the fan units 110 may include a plurality of blades arranged in a circumferential direction and fixing members 130 for fixing in place opposite ends of each of the blades 120. That is, the cross-flow fan 100 is formed having the blades 120 fixed and arranged in the circumferential direction.

Figure 4:
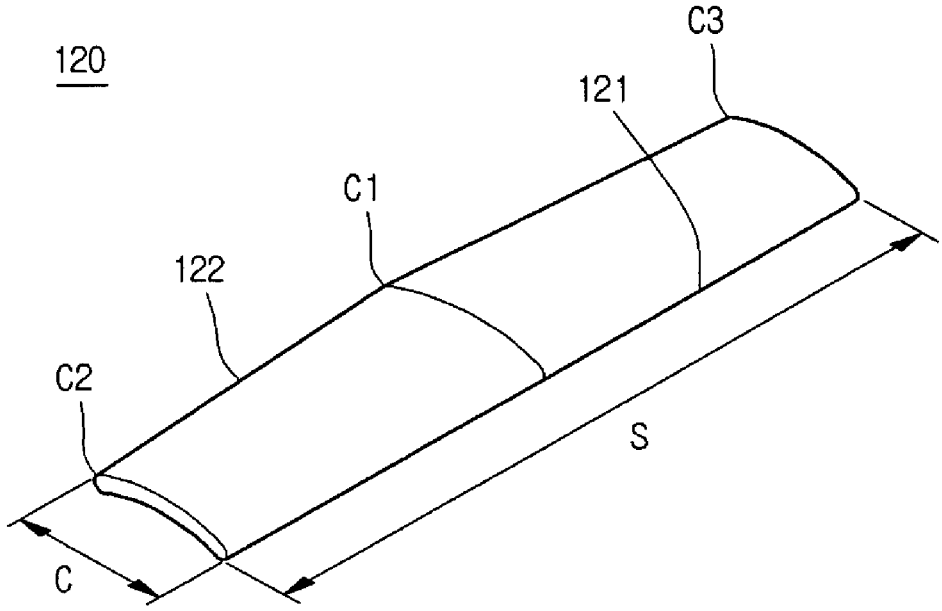
FIG. 4 is a perspective view of a blade of the cross-flow fan of FIG. 2 according to a first embodiment.

FIG. 4 is a perspective view of a blade of the cross-flow fan of FIG. 2 according to a first embodiment.

Referring to FIG. 4, a length of the blade 120 is defined as a span S and a height of the blade 120, which is perpendicular to the span S, is defined as a chord C. Further, an inner end formed along the length (span S) of the blade 120 is defined as an inner edge 121 and an outer end formed along the length (span S) of the blade 120 is defined as an outer edge 122.

When the blade 120 is installed on the cross-flow fan 100, the inner edge 121 of the blade 120 faces an inside of the cross-flow fan 100 and the outer edge 121 of the blade 120 faces an outside of the cross-flow fan 100. Here, the inner and outer edges 121 and 122 may be formed having curved cross sections. The inner edge 121 of the blade 120 may be roughly in parallel with a rotational shaft of the cross-flow fan 100.

Figure 5:
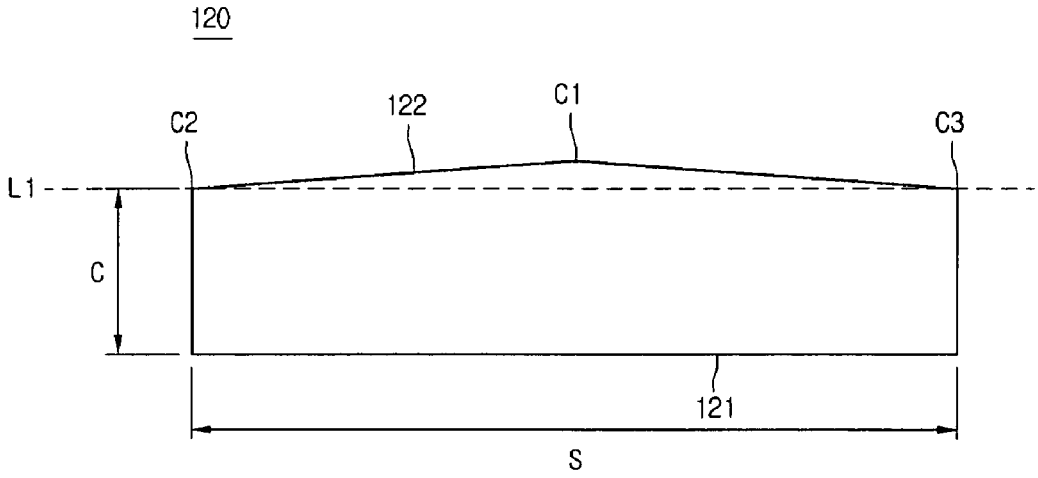
FIG. 5 is a top plane view of the blade of FIG. 4.

FIG. 5 is a top plane view of the blade of FIG. 4.

Referring to FIGS. 4 and 5, the chord C that is the height of the blade 120 may vary along the span S as defined by the outer edge 122. For example, the outer edge 122 of the blade 120 may be convexly formed. Thus, the chord C at a mid-portion C1 of the blade 120 may be longer than the chords at either side portions C2 and C3 of the blade 120. In FIG. 5, the reference symbol L1 indicates an imaginary line segment that is in parallel with a rotational shaft of the cross-flow fan 100 and interconnects opposite ends of the outer edge 122. The mid-portion C1 of the blade 120 protrudes convexly from the line segment L1.

The outer edge 122 of the blade 120 incline downward from the mid-portion C1 to the either side portions C2 and C3. Alternatively, the outer edge 122 may be formed in a wave-shape.

The blade 120 may be symmetrically formed with reference to the mid-portion C1. Needless to say, the blade 120 may be asymmetrically formed with reference to the mid-portion C1.

Figure 6:
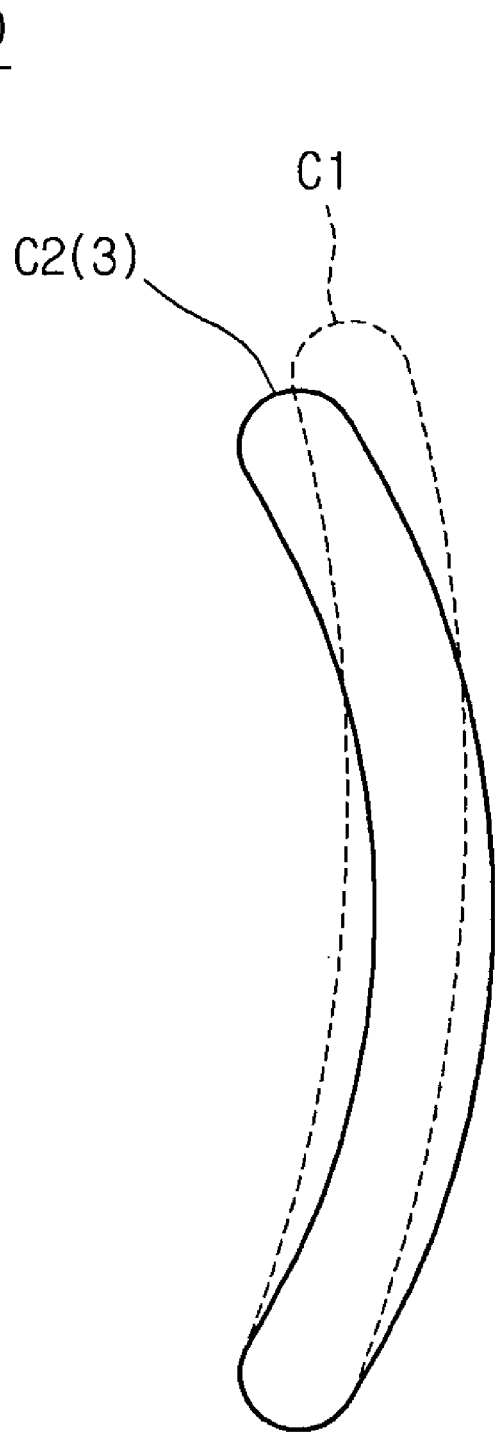
FIG. 6 is a diagram illustrating a curvature of the blade of FIG. 4.

FIG. 6 is a diagram illustrating a curvature of the blade of FIG. 4 at the mid-portion and the either side portions.

Referring to FIGS. 4 and 6, a chord section of the blade 120, which is taken along a line extending in a direction of the chord C, may be curved. At this point, the chord section of the blade may be curved and a surface of the blade, which corresponds to a rotational direction of the cross-flow fan 100, is concaved.

A curvature of the blade 120 is formed such that a curvature of a portion where the height of the outer edge 122 is high is less curved than that of a portion where the height of the outer edge 122 is low. For example, the curvature of the mid-portion C1 of the blade 120 may be less curved than those of the either side portions C2 and C3. In FIG. 6, the curvature of the mid-portion C1 in the direction of the span S is illustrated with a dotted line and the curvatures of the either side portions C2 and C3 are illustrated with a solid line. The blade 120 may be curved such that the portion where the height of the outer edge 122 is high is more gently curved as compared with the portion where the height of the outer edge 122 is low.

Figure 7:
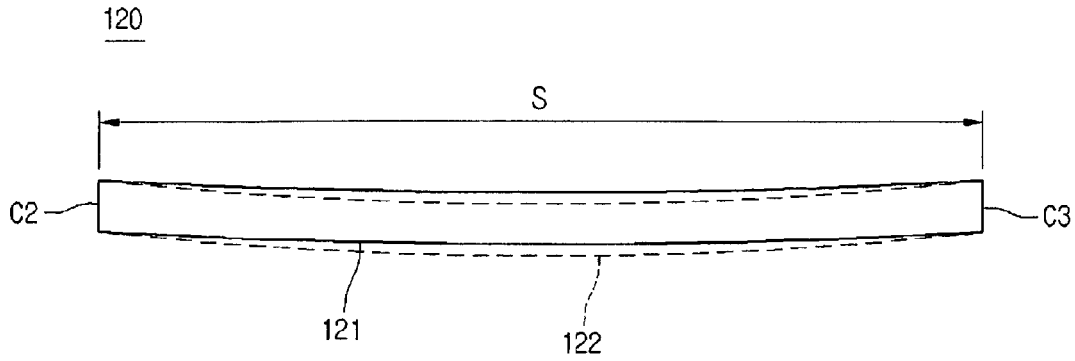
FIG. 7 is a diagram illustrating sectors of outer and inner edges of the blade of FIG. 4.

FIG. 7 is a diagram illustrating sectors of the outer and inner edges of the blade of FIG. 4.

Referring to FIGS. 4 and 7, the blade 120 may be curved along the span S. For example, either sides C2 and C3 of the blade 120 may be curved with reference to the mid-portion C1 in a direction perpendicular to the rotational direction of the cross-flow fan 100. Here, the span S of the blade 120 may be less than the overall actual length of the blade 120. In FIG. 7, the outer edge 122 of the blade 120 is illustrated with a dotted line.

Figure 8:
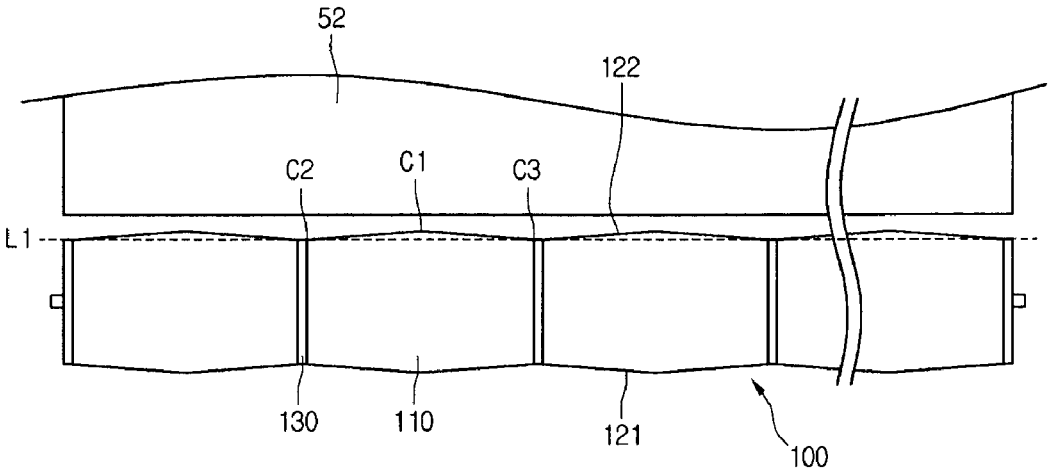
FIG. 8 is a development view illustrating a relation between a cross-flow fan having the blade of FIG. 4 and a stabilizer.

FIG. 8 is a development view illustrating a relation between the cross-flow fan having the blade of FIG. 4 and the stabilizer.

Referring to FIG. 8, the fluid flow guide 50 is disposed near the outer circumference of the cross-flow fan 100 and spaced apart from the outer circumference of the blade 120 by a predetermined distance (see FIG. 1). In FIG. 8, the stabilizer 52 of the fluid flow guide 50 and the outer circumference of the cross-flow fan 100 are illustrated.

At this point, since the cross-flow fan 100 has the fan units 110 that are connected one another in a lengthwise direction, a plurality of the blades 120 are arranged opposing an edge of the stabilizer 52.

A distance between the stabilizer 52 and the blade 120 varies along the length of the blade 120. That is, since the chord of the mid-portion C in the span (S) direction of the blade 120 is longer than those of the either side portions C2 and C3, the height defined by the outer edges 122 of the respective blades 120 varies periodically along the length of the cross-flow fan 100 (see FIG. 5). Therefore, the distance between the stabilizer 52 and the blade 120 varies along the length of the blade 120. Needless to say, a distance between the rear guide 51 and the blade 120 also varies along the length of the blade 120.

In addition, when the cross-flow fan 100 rotates, a tip of the mid-portion C1 of the outer edge 122 meets the fluid flow guide 50 earliest of all and tips of the either side portions C2 and C3 are the very last to meet the fluid flow guide 50, because the chord at the mid-portion C1 of the outer edge 122 is longest.

The following will describe operation of the air conditioner structured as described above.

Referring again to FIG. 8, as the cross-flow fan 100 rotates, the tip of the mid-portion C1 of the outer edge 122 reaches the stabilizer 52 earliest of all and the tips of the either side portions C2 and C3 of the outer edge 122 are the very last to reach the stabilizer 52. Further, each tip further from the tip of the mid-portion C1 and closer to the tips of the either side portions C2 and C3 of the outer edge 122, reaches the stabilizer 52 later. Therefore, since tips between the mid-portion C1 and one of the side portions C2 and C3 of the outer edge 122 of the blade 120 reach the stabilizer 52 at different times, those tips do not simultaneously reach the stabilizer 52. In addition, the tip of the mid-portion C1 of the outer edge 122 of the blade 120 approaches closest to the stabilizer 52 and the tips of the either side portions C2 and C3 of the outer edge 122 approach farthest from the stabilizer 52.

As described above, during the rotation of the cross-flow fan 100, tips closer to the tip of the mid-portion C1 reach the stabilizer 52 earlier than tips closer to the tips of the either side portions C2 and C3 of the outer edge 122. In addition, the distance between the outer edge 122 of the blade 120 and the stabilizer 52 varies along the length of the blade 120. Therefore, an airflow rate between the outer edge 122 of the blade and the stabilizer 52 also varies along the length of the blade 120 and thus, the interference due to air between the cross-flow fan 100 and the stabilizer 52 is significantly reduced and a peak noise value according to a noise spectrum is significantly reduced.

The following will describe a blade of the cross-flow fan according to a second embodiment.

Figure 9:
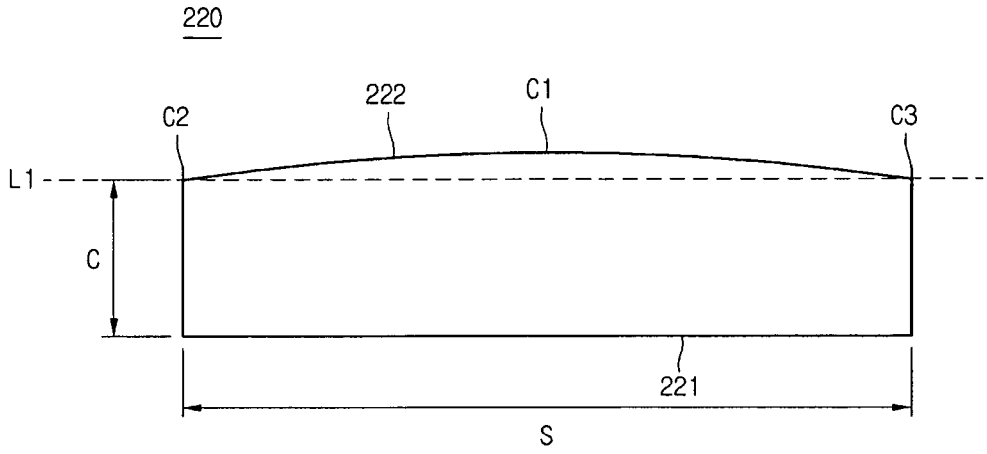
FIG. 9 is a top plane view of a blade of a cross-flow fan according to a second embodiment.

FIG. 9 is a top plane view of a blade of a cross-flow fan according to a second embodiment.

Referring to FIG. 9, an outer edge 222 of a blade 220 of this embodiment may be rounded such that a mid-portion C1 of the outer edges 222 protrudes convexly from an imaginary line segment L1 that is in parallel with a rotational shaft of a cross-flow fan and interconnects opposite ends of the outer edges 222. At this point, a chord of the mid-portion C1 of the blade 220 may be longer than chords of the either side portions C2 and C3 of the blade 220.

The blade 220 may be symmetrically formed with reference to the mid-portion C1. Needless to say, the blade 220 may be asymmetrically formed with reference to the mid-portion C1.

Figure 10:
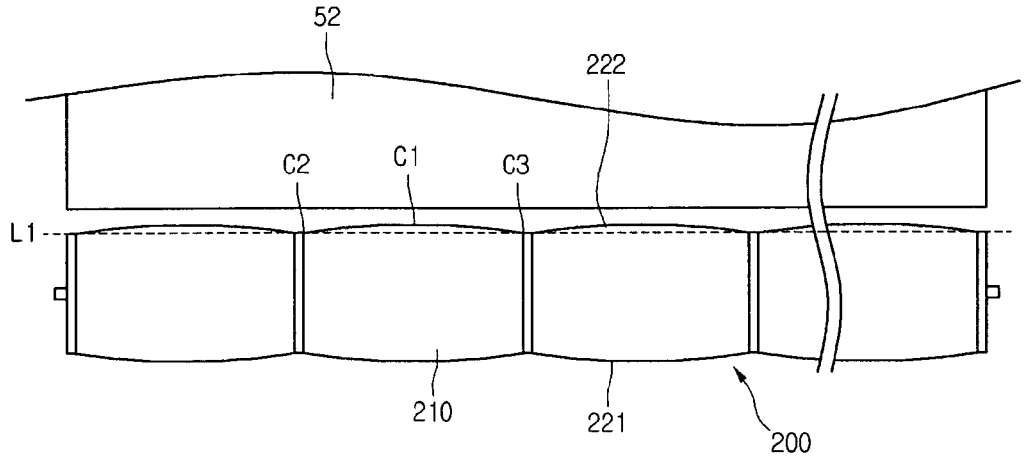
FIG. 10 is a development view illustrating a relation between a cross-flow fan having the blade of FIG. 9 and a stabilizer.

FIG. 10 is a development view illustrating a relation between the cross-flow fan having the blade of FIG. 9 and a stabilizer.

Referring to FIG. 10, the fluid flow guide 50 is disposed near the outer circumference of the cross-flow fan 200 and spaced apart from the outer circumference of the blade 220 by a predetermined distance. In FIG. 10, the stabilizer 52 of the fluid flow guide 50 and the outer circumference of the cross-flow fan 200 are illustrated.

At this point, since the cross-flow fan 200 has the fan units 210 that are connected one another in a length direction, a plurality of the blades 220 are arranged along the fluid flow guide 50.

A distance between the stabilizer 52 and the blade 220 varies along the length of the blade 220. That is, since the chord of the mid-portion C in the span (S) direction of the blade 220 is longer than those of the either side portions C2 and C3, the height defined by the outer edges 222 of the respective blades 220 varies periodically along the length of the cross-flow fan 200. Therefore, the distance between the stabilizer 52 and the blade 220 varies along the length of the blade 220. Needless to say, a distance between the rear guide 51 and the blade 220 also varies along the length of the blade 220.

In addition, when the cross-flow fan 200 rotates, a tip of the mid-portion C1 of the outer edge 222 meets the fluid flow guide 50 earliest of all and tips of the either side portions C2 and C3 are the very last to meet the fluid flow guide 50, because the chord at the mid-portion C1 of the outer edge 122 is longest.

Since the operation of the second embodiment is substantially similar to that of the first embodiment, a description thereof will be omitted herein.

The following will describe a blade of a cross-flow fan according to a third embodiment.

Figure 11:
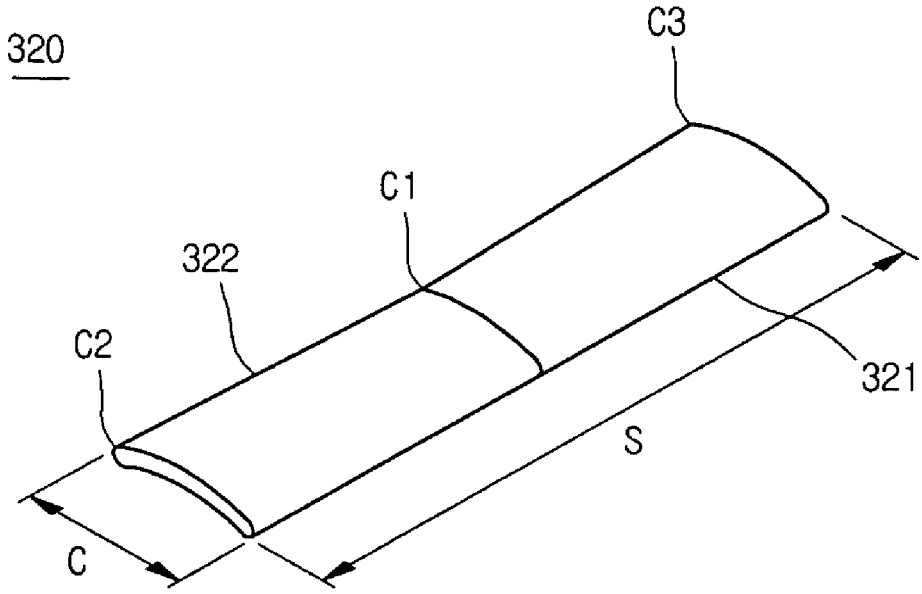
FIG. 11 is a perspective view of a blade of a cross-flow fan according to a third embodiment.

FIG. 11 is a perspective view of a blade of a cross-flow fan according to a third embodiment.

Referring to FIG. 11, a length of a blade 320 is defined as a span S and a height of the blade 320, which is perpendicular to the span S, is defined as a chord C. Further, an inner end formed along the length (span S) of the blade 320 is defined as an inner edge 321 and an outer end formed along the length (span S) of the blade 320 is defined as an outer edge 322.

When the blade 320 is installed on a cross-flow fan 300, the inner edge 321 of the blade 320 faces an inside of the cross-flow fan 300 and the outer edge 321 of the blade 320 faces an outside of the cross-flow fan 300. At this point, the inner and outer edges 321 and 322 may be formed having respective curved cross sections.

The inner edge 321 of the blade 320 may be in roughly parallel with a rotational shaft of the cross-flow fan 300.

Figure 12:
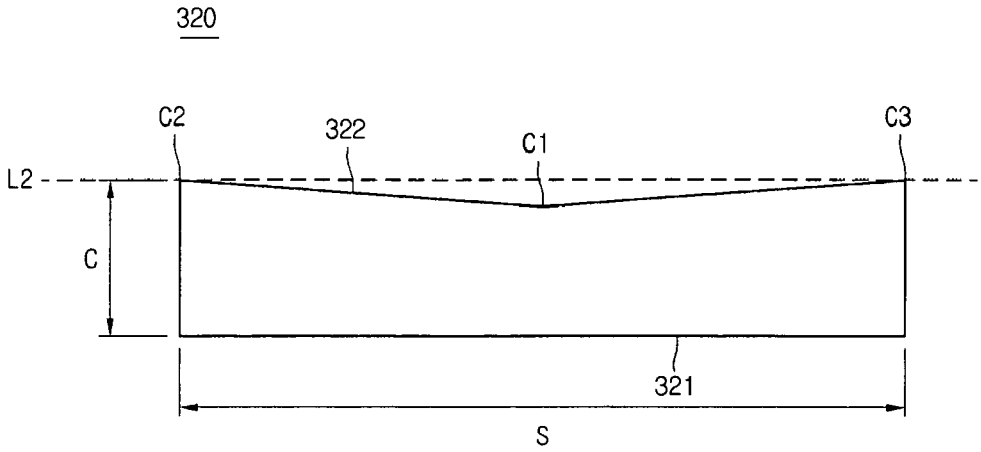
FIG. 12 is a top plane view of the blade of FIG. 11.

FIG. 12 is a top plan view of the blade of FIG. 11.

Figure 15:
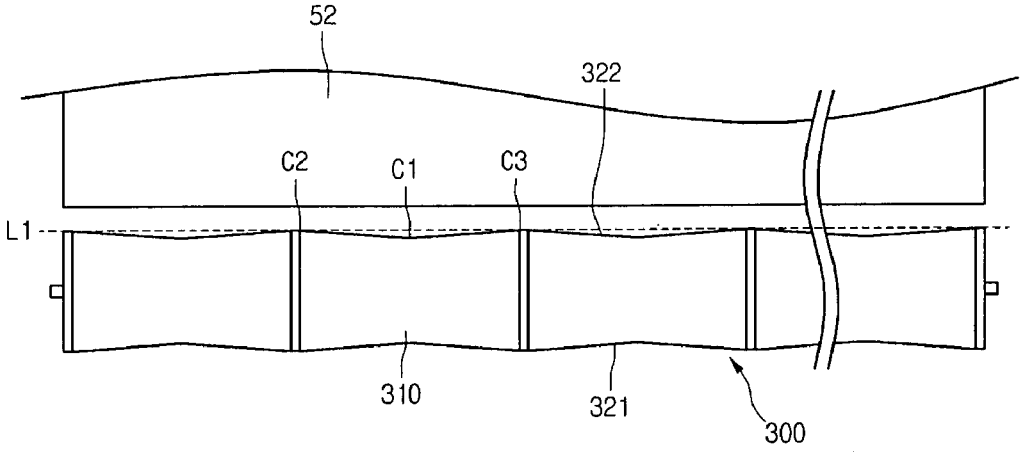
FIG. 15 is a development view illustrating a relation between a cross-flow fan having the blade of FIG. 11 and a stabilizer.

Referring to FIGS. 11 and 12, the outer edge 322 of the blade 320 may be concavely formed toward a rotational axis of the cross-flow fan 300 (see FIG. 15). At this point, the chord C at a mid-portion C1 of the blade 320 may be shorter than the chords at either side portions C2 and C3 of the blade 320. The outer edge 322 of the blade 320 incline upward from the mid-portion C1 to the either side portions C2 and C3. In FIG. 12, the reference symbol L2 indicates an imaginary line segment that is in parallel with a rotational shaft of the cross-flow fan 300 and interconnects opposite ends of the outer edge 322. The mid-portion C1 of the blade 320 inclines concavely from the imaginary line segment L2.

The blade 320 may be symmetrically formed with reference to the mid-portion C1. Needless to say, the blade 320 may be asymmetrically formed with reference to the mid-portion C1.

Figure 13:
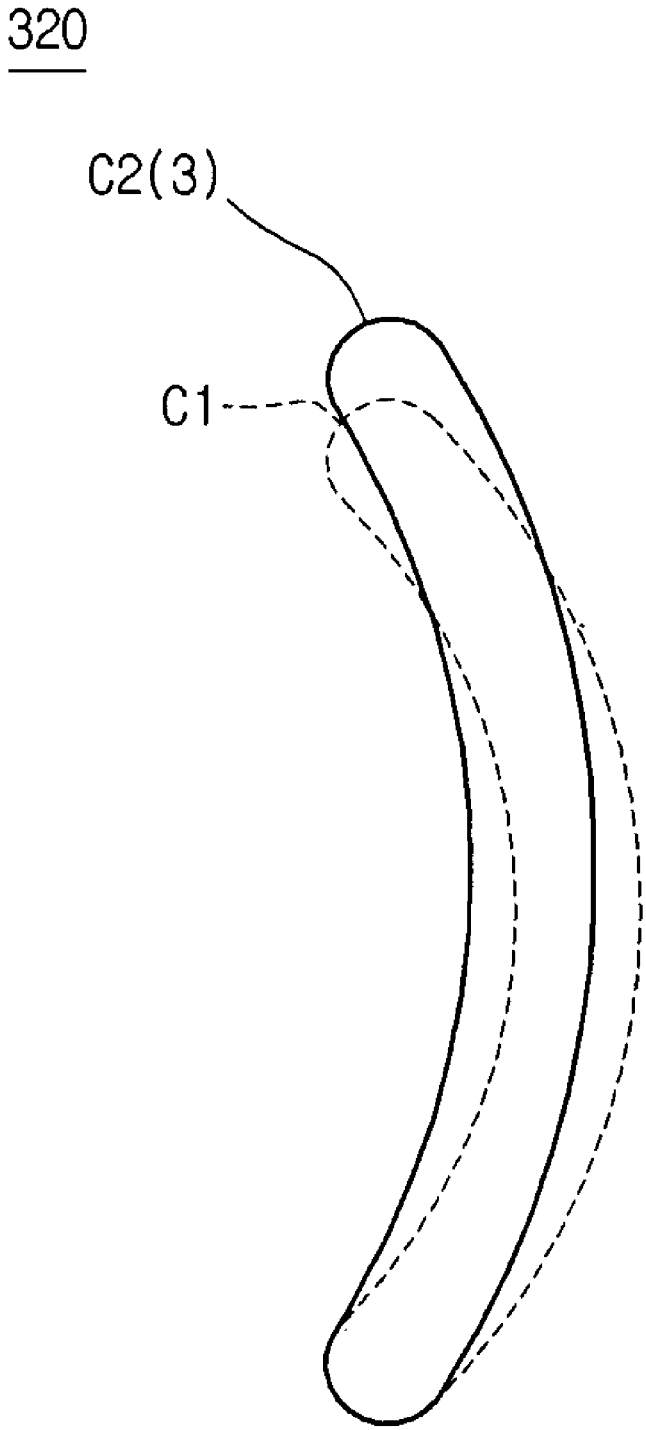
FIG. 13 is a diagram illustrating a curvature of the blade of FIG. 11.

FIG. 13 is a diagram illustrating a curvature of the blade of FIG. 11 at the mid-portion and the either side portions.

Referring to FIGS. 11 and 13, a curvature of the blade 320 is formed such that a curvature of a portion where the height of the outer edge 322 is high is less curved than that of a portion where the height of the outer edge 322 is low. That is, the blade 320 may be curved such that the chords at the either side portions C2 and C3, which are relatively high, are more gently rounded as compared with the chord at the mid-portion C1, which is relatively low. In FIG. 13, the curvature of the mid-portion C1 in the direction of the span S is illustrated with a dotted line and the curvatures of the either side portions C2 and C3 are illustrated with a solid line.

Figure 14:
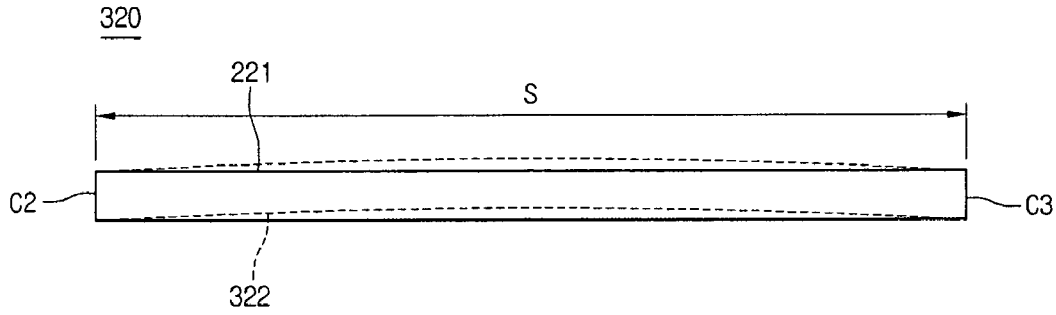
FIG. 14 is a diagram illustrating sectors of outer and inner edges of the blade of FIG. 11.

FIG. 14 is a diagram illustrating sectors of the outer and inner edges of the blade of FIG. 11.

Referring to FIGS. 11 and 14, the blade 320 may be curved along the span S. For example, either sides C2 and C3 of the blade 320 may be convexly curved with reference to the mid-portion C1 in the rotational direction of the cross-flow fan 300. Here, the span S of the blade 320 may be less than the overall actual length of the blade 320. In FIG. 14, the outer edge 322 of the blade 320 is illustrated with a dotted line.

FIG. 15 is a development view illustrating a relation between the cross-flow fan having the blade of the third embodiment and the stabilizer.

Referring to FIG. 15, the fluid flow guide 50 is disposed near the outer circumference of the cross-flow fan 300 and space apart from the outer circumference of the blade 320 by a predetermined distance. In FIG. 15, the stabilizer 52 of the fluid flow guide 50 and the outer circumference of the cross-flow fan 300 are illustrated.

At this point, since the cross-flow fan 300 has the fan units 310 that are connected one another in a lengthwise direction, a plurality of the blades 320 are arranged opposing an edge of the stabilizer 52.

A distance between the stabilizer 52 and the blade 320 varies along the length of the blade 320. That is, since the chord of the mid-portion C1 in the span (S) direction of the blade 320 is shorter than those of the either side portions C2 and C3, the height defined by the outer edges 322 of the respective blades 320 varies periodically along the length of the cross-flow fan 300. Therefore, the distance between the stabilizer 52 and the blade 320 varies along the length of the blade 320. Needless to say, a distance between the rear guide 51 and the blade 320 also varies along the length of the blade 320.

In addition, when the cross-flow fan 300 rotates, tips of the either side portions C2 and C3 of the outer edge 322 meets the fluid flow guide 50 earliest of all and a tip of the mid-portion C1 is the very last to meet the fluid flow guide 50, because the chord at the mid-portion C1 of the outer edge 322 is shortest.

The following will describe operation of the air conditioner structured as described above.

Referring again to FIG. 15, as the cross-flow fan 300 rotates, the tips of the either side portions C2 and C3 of the outer edge 322 reach the stabilizer 52 earliest of all and the tip of the mid-portion C1 of the outer edge 322 is the very last to reach the stabilizer 52. Further, each tip further from the tip of the mid-portion C1 and closer to the tips of the either side portions C2 and C3 of the outer edge 322, reaches the stabilizer 52 earlier. Therefore, since tips between the mid-portion C1 and one of the side portions C2 and C3 reach the stabilizer 52 at different times, those tips do not simultaneously reach the stabilizer 52. In addition, the tip of the mid-portion C1 of the outer edge 322 of the blade 320 approaches farthest from the stabilizer 52 and the tips of the either side portions C2 and C3 of the outer edge 322 approaches closest to the stabilizer 52.

As described above, during the rotation of the cross-flow fan 300, tips closer to the tip of the mid-portion C1 reach the stabilizer 52 later than tips closer to the tips of the outer edges 322. In addition, the distance between the outer edge 322 of the blade 320 and the stabilizer 52 varies along the length of the blade 320. Therefore, an airflow rate between the outer edge 322 of the blade and the stabilizer 52 also varies along the length of the blade 320 and thus, the interference due to air between the cross-flow fan 300 and the stabilizer 52 is significantly reduced and a noise peak value according to a noise spectrum is significantly reduced.

The following will describe a blade of the cross-flow fan according to a fourth embodiment.

Figure 16:
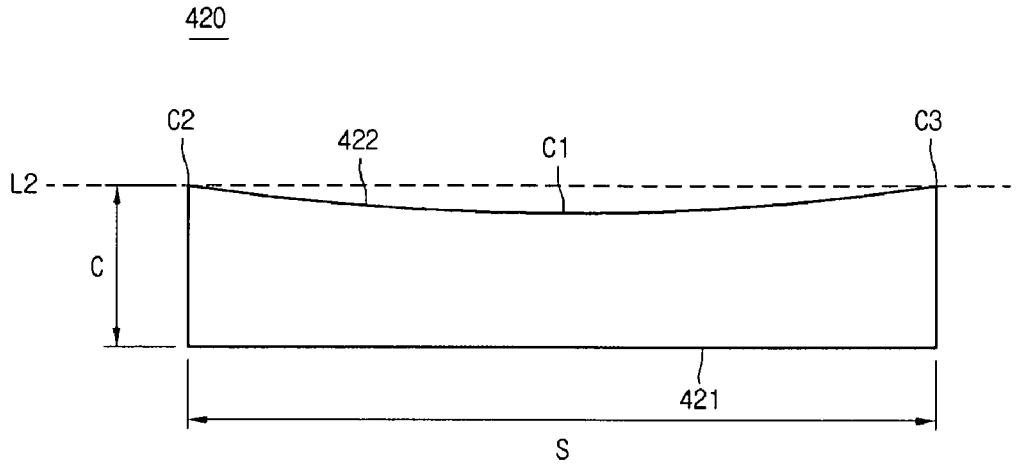
FIG. 16 is a top plane view of a blade of a cross-flow fan according to a fourth embodiment.

FIG. 16 is a top plan view of a blade of a cross-flow fan according to a fourth embodiment.

Referring to FIG. 16, an outer edge 422 of a blade 420 of this embodiment may be curved such that a mid-portion C1 of the outer edges 422 is concaved from a line segment L1 that is in parallel with a rotational shaft of a cross-flow fan and interconnects opposite ends of the outer edges 422. At this point, a chord of the mid-portion C1 of the blade 220 may be shorter than chords of the either side portions C2 and C3 of the blade 420.

The blade 420 may be symmetrically formed with reference to the mid-portion C1. Needless to say, the blade 420 may be asymmetrically formed with reference to the mid-portion C1.

Figure 17:
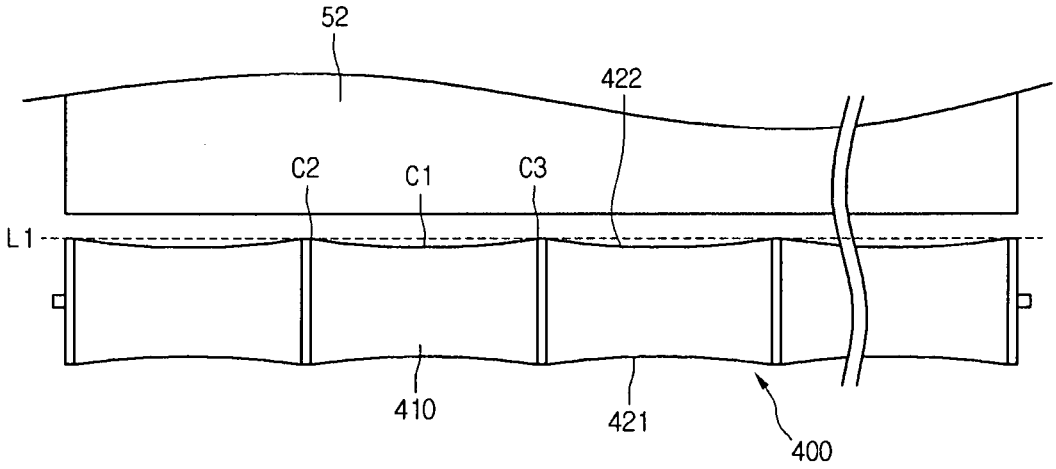
FIG. 17 is a development view illustrating a relation between a cross-flow fan having the blade of FIG. 16 and a stabilizer.

FIG. 17 is a development view illustrating a relation between the cross-flow fan having the blade of FIG. 16 and a stabilizer.

Referring to FIG. 17, the stabilizer 52 is disposed near the outer circumference of the cross-flow fan 400 and spaced apart from an outer circumference of the blade 420 by a predetermined distance. In FIG. 17, the stabilizer 52 of the fluid flow guide 50 and the outer circumference of the cross-flow fan 400 are illustrated.

At this point, since the cross-flow fan 400 has the fan units 410 that are connected one another in a length direction, a plurality of the blades 420 are arranged along the fluid flow guide 50.

A distance between the stabilizer 52 and the blade 420 varies along the length of the blade. 420. That is, since the chord of the mid-portion C in the span (S) direction of the blade 420 is shorter than those of the either side portions C2 and C3, the height defined by the outer edges 422 of the respective blades 420 varies periodically along the length of the cross-flow fan 400. Therefore, the distance between the stabilizer 52 and the blade 420 varies along the length of the blade 420. Needless to say, a distance between the rear guide 51 and the blade 420 also varies along the length of the blade 420.

In addition, when the cross-flow fan 400 rotates, tips of the mid-portion C1 of the outer edge 422 meet the edge of the stabilizer 52 earliest of all and a tip of the mid-portion C1 of the outer edge 422 is the very last to meet the edge of the stabilizer 52, because the chord at the mid-portion C1 of the outer edge 122 is shortest.

Since the operation of the fourth embodiment is substantially similar to that of the third embodiment, a description thereof will be omitted herein.

Although embodiments have been described with reference to a number of illustrations thereof, it should be understood that numerous other modifications and embodiments can be devised by those skilled in the art that will fall within the spirit and scope of the principles of the invention. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cross-flow fan comprising:

a plurality of blades arranged at least in a partial circumference, at least one of the blades defining a span which is a length of the blade and a chord which is a height of the blade, perpendicular to the span, wherein the chord includes a first chord at a center portion of the blade and a second chord at a side portion of the blade, wherein a longitudinal axis of one blade is substantially parallel to another longitudinal axis of another blade, and the height of the blade varies along an edge of the blade such that the first chord is different from that of the second chord, and wherein a curvature of a portion of the blade corresponding to one of the first and second chords is greater than a curvature of a portion of the blade corresponding to the other one of the first and second chords, and the one is higher than the other one.

2. The cross-flow fan of claim 1, wherein an edge of the blade is convex.

3. The cross-flow fan of claim 1, wherein an edge of the blade is concave.

4. The cross-flow fan of claim 1, wherein an edge of the blade is curved.

5. The cross-flow fan of claim 1, wherein the blade is bent.

6. The cross-flow fan of claim 1, wherein a cross-section of the blade is curved.

7. The cross-flow fan of claim 6, wherein a cross-section of an outer section of the blade is more curved than a cross-section of an inner section of the blade.

8. The cross-flow fan of claim 6, wherein a cross-section of an outer section of the blade is less curved than a cross-section of an inner section of the blade.

* * * * *